US009097429B2

(12) United States Patent
Nam

(10) Patent No.: US 9,097,429 B2
(45) Date of Patent: Aug. 4, 2015

(54) COOKING APPLIANCE AND AN OPERATING METHOD FOR THE SAME

(75) Inventor: Hyeun Sik Nam, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 901 days.

(21) Appl. No.: 13/266,982

(22) PCT Filed: Sep. 9, 2009

(86) PCT No.: PCT/KR2009/005122

§ 371 (c)(1),
(2), (4) Date: Jan. 9, 2012

(87) PCT Pub. No.: WO2010/128723

PCT Pub. Date: Nov. 11, 2010

(65) Prior Publication Data

US 2012/0125312 A1 May 24, 2012

(30) Foreign Application Priority Data

May 4, 2009 (KR) ..... 10-2009-0039002

(51) Int. Cl.
*F24C 15/16* (2006.01)

(52) U.S. Cl.
CPC ..... *F24C 15/16* (2013.01)

(58) Field of Classification Search
CPC ..... F24C 15/16; F24C 15/168
USPC ..... 126/25 A, 273 R; 211/184; 219/395
See application file for complete search history.

(56) References Cited

U.S. PATENT DOCUMENTS

| | | | | | |
|---|---|---|---|---|---|
| 97,489 | A | * | 12/1869 | Edson | 187/267 |
| 104,161 | A | * | 6/1870 | Johnson | 108/147 |
| 647,491 | A | * | 4/1900 | Hoffmann | 74/424.7 |
| 1,113,744 | A | * | 10/1914 | Bjorkström | 187/271 |
| 1,392,078 | A | * | 9/1921 | Ouillett | 187/271 |
| 1,533,256 | A | * | 4/1925 | McCaul | 126/337 A |
| 1,851,183 | A | * | 3/1932 | Hill | 126/337 A |
| 2,593,233 | A | * | 4/1952 | White | 126/39 C |
| 2,781,037 | A | * | 2/1957 | Vuncannon | 126/25 A |
| 2,919,691 | A | * | 1/1960 | Rinaldo et al. | 126/337 A |
| 2,968,301 | A | * | 1/1961 | Cowart | 126/25 A |
| 2,994,760 | A | * | 8/1961 | Pecoraro et al. | 219/394 |

(Continued)

FOREIGN PATENT DOCUMENTS

| | | | | |
|---|---|---|---|---|
| GB | 2321962 | A | * | 8/1998 |
| GB | 2321962 | B | * | 9/2000 |

(Continued)

OTHER PUBLICATIONS

Kim, KR 854155 B1, Aug. 2008, English machine translation.*

*Primary Examiner* — Jorge Pereiro
(74) *Attorney, Agent, or Firm* — McKenna Long & Aldridge LLP

(57) ABSTRACT

A cooking appliance including: a cavity having a cooking space; a separating plate which forms a plurality of compartments from the cooking space of the cavity, and is provided so as to move inside the cavity in such a way as to be able to vary the sizes of the compartmentalized cooking spaces; a first heating source positioned so as to cook an item to be cooked provided in one of the cooking spaces; a second heating source positioned so as to cook an item to be cooked provided in another of the cooking spaces; and a separating-plate moving mechanism for moving the separating plate vertically.

11 Claims, 11 Drawing Sheets

(56) References Cited

U.S. PATENT DOCUMENTS

| | | | | | |
|---|---|---|---|---|---|
| 3,043,290 | A * | 7/1962 | Smith | 126/337 A |
| 3,059,634 | A * | 10/1962 | Brinkman et al. | 126/337 R |
| 3,982,801 | A * | 9/1976 | Heidorn et al. | 312/306 |
| 4,357,513 | A * | 11/1982 | Kawata et al. | 219/685 |
| 4,690,362 | A * | 9/1987 | Helgeland | 248/404 |
| 4,833,304 | A * | 5/1989 | Ueda | 219/518 |
| 5,429,043 | A * | 7/1995 | Becker | 99/448 |
| 5,618,458 | A * | 4/1997 | Thomas | 219/394 |
| 5,706,739 | A * | 1/1998 | Shaheen et al. | 108/147 |
| 5,743,193 | A * | 4/1998 | Kakuta et al. | 108/147 |
| 5,938,959 | A * | 8/1999 | Wang | 219/401 |
| 6,818,869 | B2 * | 11/2004 | Patti et al. | 219/489 |
| 7,071,448 | B1 * | 7/2006 | Kim et al. | 219/394 |
| 7,087,863 | B1 * | 8/2006 | Kim et al. | 219/394 |
| 7,129,447 | B1 * | 10/2006 | Kim et al. | 219/394 |
| 7,183,520 | B2 * | 2/2007 | Park | 219/394 |
| 7,297,905 | B2 * | 11/2007 | Kim et al. | 219/400 |
| 8,215,732 | B2 * | 7/2012 | Kim | 312/408 |
| 8,217,314 | B2 * | 7/2012 | Kim et al. | 219/400 |
| 2006/0096969 | A1 * | 5/2006 | Kim | 219/394 |
| 2006/0131297 | A1 * | 6/2006 | Kim et al. | 219/394 |
| 2006/0289435 | A1 * | 12/2006 | Park | 219/394 |
| 2008/0308545 | A1 * | 12/2008 | Kim et al. | 219/400 |
| 2010/0176703 | A1 * | 7/2010 | Kim | 312/408 |

FOREIGN PATENT DOCUMENTS

| | | | |
|---|---|---|---|
| KR | 20-1998-0021891 | U | 7/1998 |
| KR | 10-2006-0012832 | A | 2/2006 |
| KR | 10-2007-0013077 | A | 1/2007 |
| KR | 10-2007-0018449 | A | 2/2007 |
| KR | 854155 | B1 * | 8/2008 |

* cited by examiner

COOKING APPLIANCE AND AN OPERATING METHOD FOR THE SAME

This application is a National Stage Entry of International Application No. PCT/KR2009/005122, filed Sep. 9, 2009, and claims the benefit of Korean Application No. 10-2009-0039002, filed on May 4, 2009, each of which is incorporated herein by reference for all purposes.

TECHNICAL FIELD

The present invention relates to a cooking appliance and an operation method thereof, and more particularly, to a cooking appliance, in which a cooking space in a cavity is divided into a plurality of spaces, and an operation method thereof.

BACKGROUND ART

In general, a cooking appliance is a device for cooking or heating food using a heating source. The heating source includes an electric heater for generating heat upon application of electricity, a burner which generates heat using fossil fuel, and an induction heater which induces electricity to flow through a cooking container made of metal using an electromagnetic force.

An example of such cooking appliances includes a cooking appliance having a plurality of cooking spaces, each of the cooking spaces being heated by a heating source. For example, the cooking appliance has an upper cooking space and a lower cooking space: food such as fish is cooked in the upper cooking space; and food, for example, chicken, having a different cooking temperature to that of the food to be cooked in the upper cooking space is input and cooked in a lower cooking space.

However, the cooking appliance having a plurality of cooking spaces has the problem that fixed sizes of the cooking spaces make efficient cooking difficult depending on the size of food.

DISCLOSURE

Technical Problem

The present invention has been made in an effort to solve the problems occurring in the prior art, and it is an object of the present invention to provide a cooking appliance, which can vary the sizes of a plurality of cooking spaces.

It is another object of the present invention to provide an operation method of a cooking appliance, which can adjust the sizes of the cooking spaces and the cooking temperature of the cooking spaces in accordance with the sizes of the items to be cooked.

Technical Solution

In order to solve the aforementioned problem, there is provided a cooking appliance according to the present invention, including: a cavity having a cooking space; a separating plate which forms a plurality of compartments from the cooking space of the cavity, and is provided so as to move inside the cavity; a first heating source positioned so as to cook an item to be cooked provided in one of the cooking spaces; a second heating source positioned so as to cook an item to be cooked provided in another of the cooking spaces; and a separating-plate moving mechanism for moving the separating plate vertically so as to vary the sizes of the cooking spaces.

The separating plate is a plate material disposed to compartmentalize the cooking space of the cavity, the first heating source is an upper heater disposed on top of the cavity for heating the item supplied to the upper side of the separating plate, and the second heating source is a lower heater disposed on the bottom of the cavity for heating the item supplied to the lower side of the separating plate.

The cooking appliance further comprises a third heating source disposed behind the cavity for heating the plurality of cooking spaces altogether.

The cooking appliance further comprises: an input part for inputting variations in the position of the separating plate and inputting different cooking temperature conditions for the cooking spaces; and a controller for controlling the separating-plate moving mechanism in accordance with an input from the input part, and, upon receipt of a different cooking temperature condition from the input part, controlling the first heating source and the second heating source at different temperatures.

The separating plate moving mechanism comprises a driving source, a driving gear connected to the driving source, and a driven gear engaged with the driving gear and connected to the separating plate.

The driven gear is longitudinally formed in a direction orthogonal to the separating plate.

The driven gear is formed at the center of the longitudinal or lateral direction of the separating plate.

The driving gear is a pinion connected to the driving source, and the driven gear is a rack disposed on the separating plate and engaged with the pinion.

The driving gear is a driving worm gear connected to a moving motor, and the driven gear is a driven worm gear disposed on the separating plate and engaged with the worm gear.

The driving gear is longitudinally vertically formed, and the driven gear protrudes next to the separating plate so as to be vertically moved along the driving gear.

The driving gear is a screw having a screw thread formed on the outer surface, and the driven gear is a lifting and lowering member which encloses part of the screw and has a screw thread engaged with the thread of the screw so that the driven gear is lifted and lowered by being guided by the screw upon rotation of the screw.

The lifting and lowering member is disposed to protrude on the separating plate.

There is provided an operation method of a cooking appliance according to the present invention, the method comprising: inputting a cavity having a cooking space cavity so as to vary the size of a separating plate disposed to compartmentalise a cavity into a plurality of cooking spaces, and inputting different cooking temperature conditions for the plurality of cooking spaces; moving the separating plate to a position input in the inputting of a separate plate position; and when a cooking start command is input after the moving of the separating plate, controlling the heating sources installed to heat the plurality of cooking spaces independently at different temperatures.

Advantageous Effects

The present invention thus-configured has an advantage that items to be cooked of various sizes can be cooked together conveniently by varying the sizes of a plurality of cooking spaces depending on the sizes of the items to be cooked.

Moreover, there is another advantage that the items of the cooking spaces compartmentalised by the separating plate can be cooked at different temperatures since the heating sources are controlled to have different temperatures, thus increasing convenience.

BEST MODE

Hereinafter, an exemplary embodiment of the present invention will be described in detail with reference to the accompanying drawings.

Figure 1:
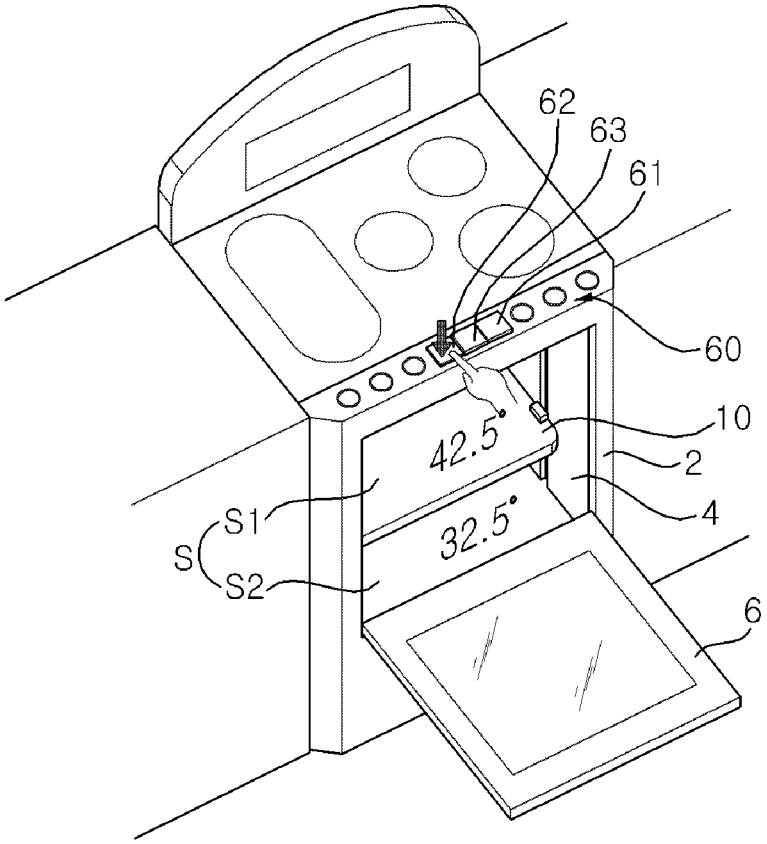
FIG. 1 is a perspective view of a cooking appliance according to an exemplary embodiment of the present invention.
Figure 2:
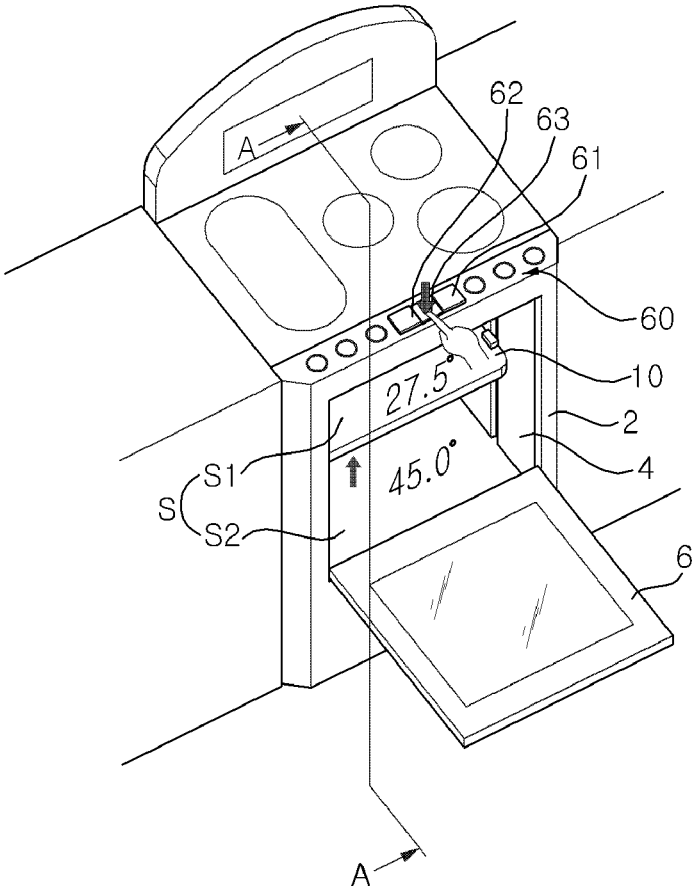
FIG. 2 is a perspective view when an upper cooking space among cooking spaces of a cavity shown in FIG. 1 is larger than a lower cooking space.
Figure 3:
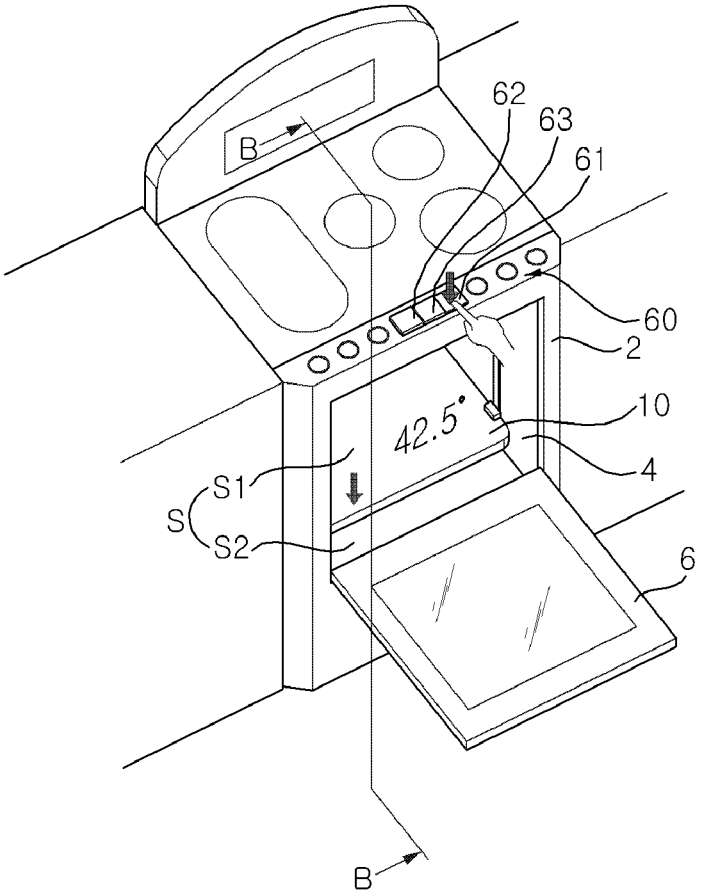
FIG. 3 is a perspective view when the lower cooking space among the cooking spaces of the cavity shown in FIG. 1 is larger than the upper cooking space.
Figure 4:
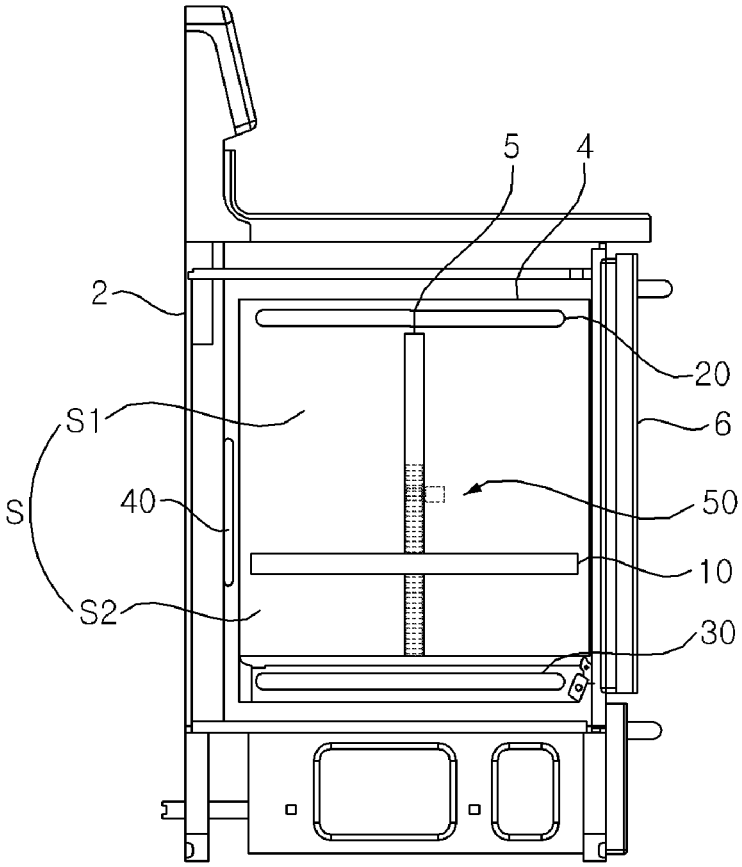
FIG. 4 is a side cross-sectional view taken along line A-A of FIG. 2.
Figure 5:
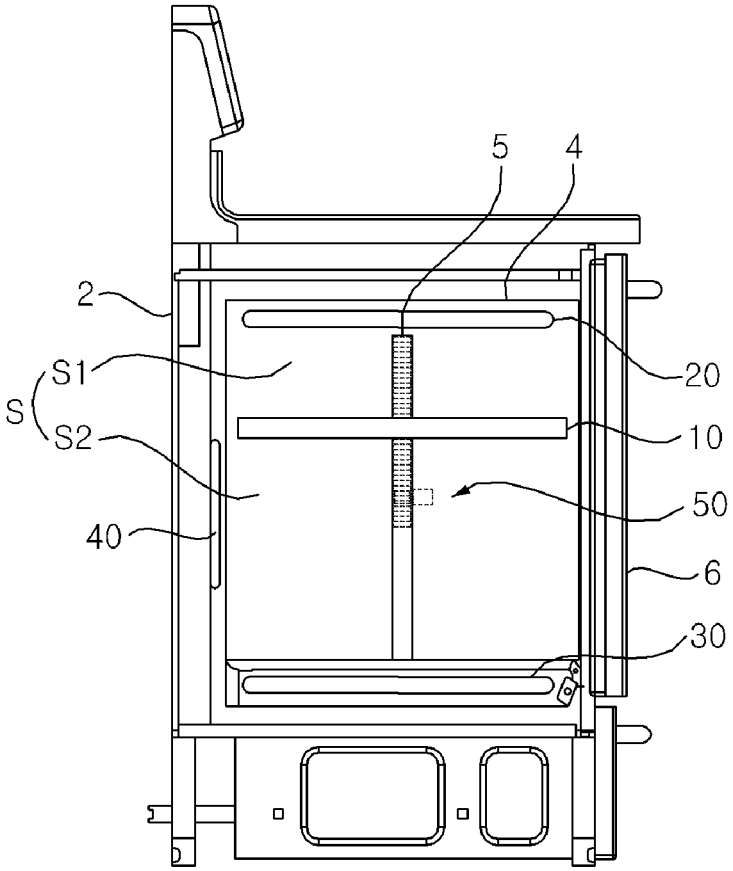
FIG. 5 is a side cross-sectional view taken along line B-B of FIG. 3.
Figure 6:
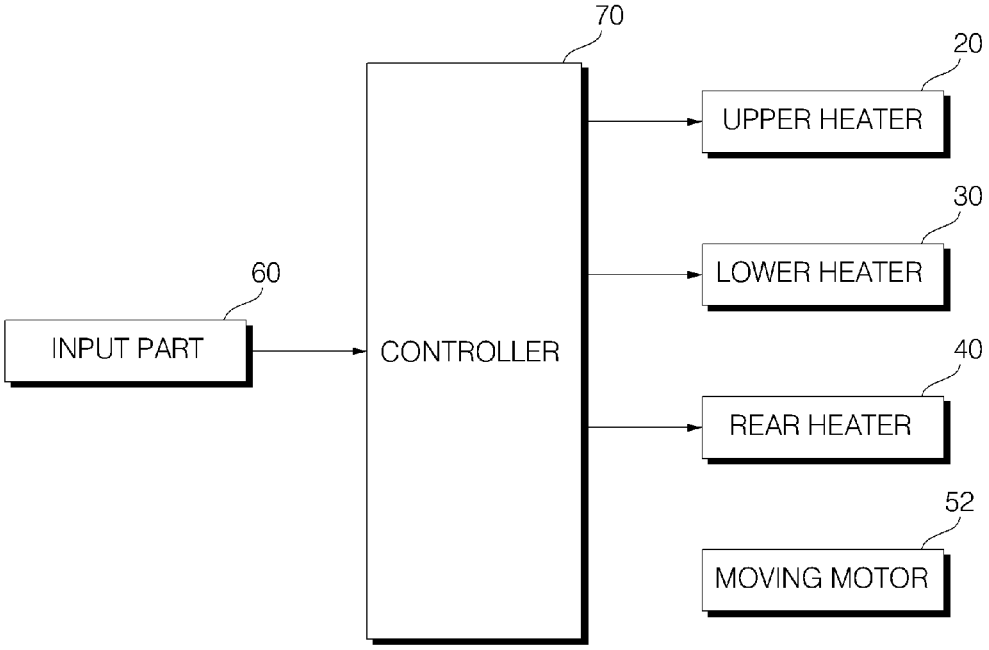
FIG. 6 is a control block diagram of a cooking appliance according to an exemplary embodiment of the present invention.

FIG. 1 is a perspective view of a cooking appliance according to an exemplary embodiment of the present invention, FIG. 2 is a perspective view when an upper cooking space among cooking spaces of a cavity shown in FIG. 1 is larger than a lower cooking space, FIG. 3 is a perspective view when the lower cooking space among the cooking spaces of the cavity shown in FIG. 1 is larger than the upper cooking space, FIG. 4 is a side cross-sectional view taken along line A-A of FIG. 2, FIG. 5 is a side cross-sectional view taken along line B-B of FIG. 3, and FIG. 6 is a control block diagram of a cooking appliance according to an exemplary embodiment of the present invention.

As shown in FIGS. 1 to 5, the cooking appliance according to the present exemplary embodiment includes an outer case 2 forming an outer appearance and a cavity 4 disposed within the outer case 2 and having a cooking space S for cooking an item.

The front surfaces of the outer case 2 and the cavity 4 are opened, and a door 6 for opening and closing the cooking space S is rotatably or slidably disposed on the outer case 2 or the cabinet 4.

The cavity 4 is provided with a separating plate 10 which compartmentalises the cooking space S of the cavity 4 into a plurality of compartments S1 and S2, and varies the sizes of the compartmentalised cooking spaces.

The separating plate 10 is disposed so as to move inside the cavity 4.

The cooking appliance further includes a separating-plate moving mechanism for moving the separating plate 10 vertically.

The separating plate 10 is a plate material disposed to compartmentalise the cooking space S of the cavity 4, which is a kind of barrier for shielding the plurality of cooking spaces S1 and S2, and blocks the plurality of cooking spaces S1 and S2 to prevent movement of hot air between the plurality of cooking spaces S1 and S2.

In the cooking appliance, the separating plate 10 can be horizontally disposed in the cavity 4 and moved up and down to thereby separate the cooking space S into upper and lower parts, or can be vertically disposed in the cavity 4 and laterally moved, thereby moving the cooking space S laterally.

The separating-plate moving mechanism 50 is disposed to lift or lower the separating plate 10 if the separating plate 10 is horizontally disposed, and the separating-plate moving mechanism 50 is disposed to laterally and linearly move the separating plate 10.

Typically, the cooking container is longer in the lateral direction than in the longitudinal direction, and the height of one S1 of the cooking spaces S1 and S2 can be sufficiently increased. Thus, it is preferable that the separating plate 10 is horizontally disposed, and the separating-plate moving mechanism 50 lifts and lowers the separating plate 10.

Hereinafter, the separating plate 10 is described to be disposed horizontally within the cavity 4, and the separating-plate moving mechanism 50 lifts or lowers the separating plate 10. The separating plate 10 functions as a base or support for supporting an item put in the cooking space S1 positioned at the upper side.

Meanwhile, a plurality of heating sources 20, 30, and 40 are disposed in the cooking appliance to supply heat to the cooking space S1.

The heating sources 20, 30, and 40 include a first heating source 20 for cooking an item supplied to one S1 of the cooking spaces S1 and S2 and a second heating source 30 for cooking an item supplied to the other one S2 of the cooking spaces S1 and S2.

The heating sources 20, 30, and 40 include a third heating source 40 for simultaneously cooking the items supplied to the cooking spaces S1 and S2 by heating the plurality of cooking spaces S1 and S2 altogether.

The first heating source is an upper heater disposed on top of the cavity 4 for heating the item supplied to the upper side of the separating plate 10.

The second heating source 30 is a lower heater disposed on the bottom of the cavity 4 for heating the item supplied to the lower side of the separating plate 10.

The third heating source 40 is a convection heater mechanism disposed behind the cavity 4 for heating the foods supplied to the upper and lower sides of the separating plate 10.

The third heating source 40 may include a plurality of rear heaters and a plurality of rear fans. This enables the upper rear heater and the upper rear fan disposed on top of the third heating source 40 to supply hot air to the upper side of the separating plate 10 and enables the lower rear heater and the lower rear fan disposed on the bottom thereof to supply hot air to the lower side of the separating plate 10.

The third heating source 40 includes one rear heater and one rear fan. An upper hot air discharge opening and an upper hot air inlet opening are formed on top of the back plate of the cavity 4 and a lower hot air discharge opening and a lower hot air inlet opening are formed on the bottom of the back plate of the cavity. As the hot air heated by the rear heater is discharged simultaneously through the upper hot air discharge opening and the lower hot air discharge opening, the hot air can be supplied to the upper and lower sides of the separating plate 10.

The cooking appliance further includes an input part 60 for allowing a user to input manipulation commands of the cooking appliance and a controller 70 for controlling a moving motor 52 of the separating-plate moving mechanism 50 and the plurality of heating sources 20, 30, and 40 in accordance with an input from the input part 60.

The input part 60 has a start/stop input part 61 for inputting cooking start/stop commands.

The input part 60 is configured to input variations in the position of the separating plate 10 and input different cooking temperature conditions for the cooking spaces S1 and S2. The input part 60 has a position variation input part 62 for varying the position of the separating plate 10 and a cooking temperature condition input part 63 for inputting cooking temperature conditions of the cooking spaces S1 and S2.

The controller 70 controls the separating-plate moving mechanism 50 in accordance with an input from the input part 60, and, upon receipt of a different cooking temperature condition from the input part 60, controls the first heating source 30 and the second heating source 40 at different temperatures.

The controller 70 controls the third heating source 50, as well as controlling the first heating source 30 and the second heating source 40.

Figure 7:
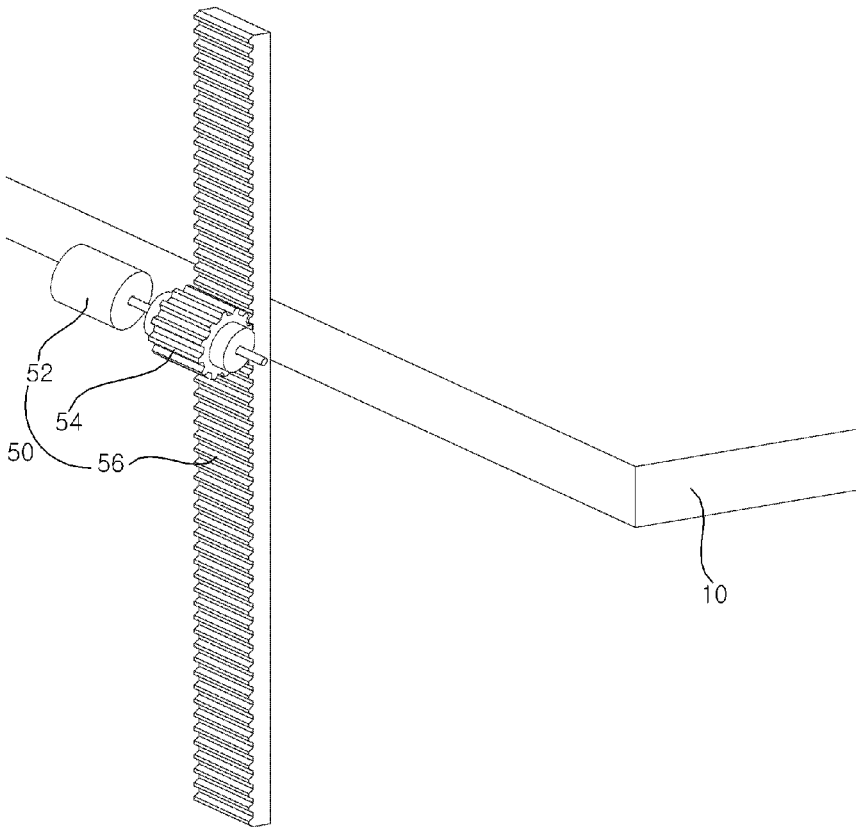
FIG. 7 is a perspective view of the separating-plate moving mechanism shown in FIGS. 4 and 5.
Figure 8:
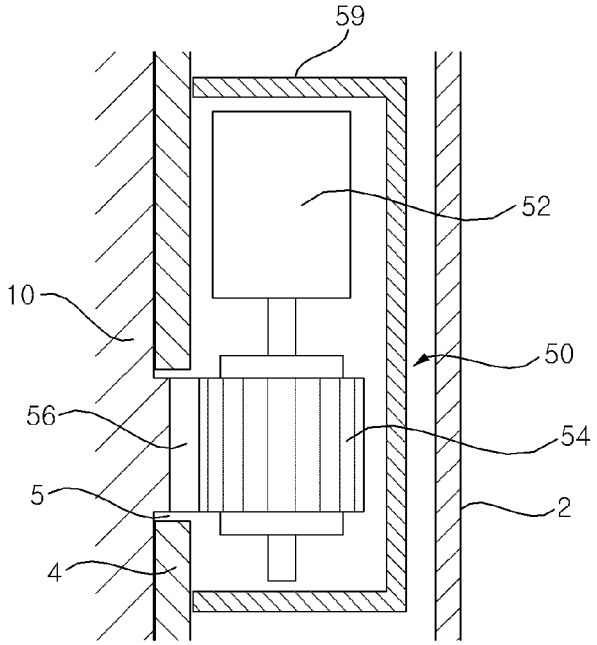
FIG. 8 is a plan view of the separating-plate moving mechanism shown in FIGS. 4 and 5.

FIG. 7 is a perspective view of the separating-plate moving mechanism shown in FIGS. 4 and 5, and FIG. 8 is a plan view of the separating-plate moving mechanism shown in FIGS. 4 and 5.

The separating-plate moving mechanism 50 includes a driving source 52, a driving gear 54 connected to the driving source 52, and a driven gear 56 engaged with the driving gear 54 and connected to the separating plate 10.

The driving source 52 is composed of a moving motor disposed in the cavity or the outer case 2.

The driving gear 54 is composed of a pinion connected to the moving motor, i.e., the driving source.

The driven gear 56 is formed longitudinally in a direction orthogonal to the separating plate 10. The driven gear 56 is formed at the center of the longitudinal or lateral direction of the separating plate 10. The driven gear 56 is composed of a rack disposed on the separating plate 10 and engaged with the pinion.

A driven gear guide 5 for guiding the driven gear 56 is longitudinally formed in the cavity 4 in the moving direction of the driven gear 56.

The separating-plate moving mechanism 50 further includes a moving case 59 for accepting a driving motor, which is the driving source 52, and a pinion, which is the driving gear 54.

The moving case 59 is opened on a surface facing the driven gear guide 5 to engage the driven gear 56 with the driving gear 54.

The moving case 59 may be disposed between the cavity and the outer case 2, or may be bent integral with the cavity 4.

Preferably, the moving case 59 is formed to have such length and shape as to cover the entire driven gear guide 5 to prevent hot air passing through the driven gear guide 5 from flowing out between the cavity 4 and the outer case 2.

Figure 9:
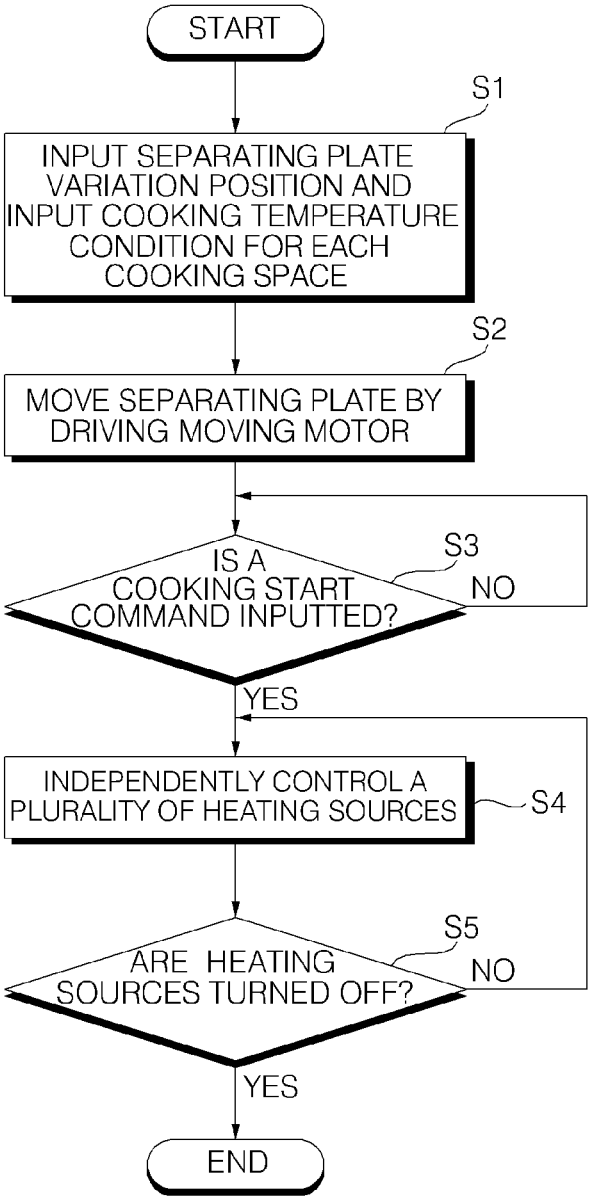
FIG. 9 is a sequential chart of an operation method of a cooking appliance according to one exemplary embodiment of the present invention.

FIG. 9 is a sequential chart of an operation method of a cooking appliance according to one exemplary embodiment of the present invention.

The operation method of the cooking appliance according to one exemplary embodiment of the present invention includes an input step, a separating-plate moving step, and a heating source control step.

In the input step S1, a variation in the position of the separating plate 10 is input to vary the position of the separating plate 10 disposed to compartmentalise the cavity 4 into a plurality of cooking spaces S1 and S2, and different cooking temperature conditions for the plurality of cooking spaces S1 and S2 are input.

In the input step S1, the user inputs the sizes of the plurality of cooking spaces S1 and S2 by stages through the position variation input part 62 of the input part 60. For example, the height ratio between the cooking spaces is 1:5, 2:4, 3:4, 4:2, and 5:1.

In the input step S1, cooking temperature conditions for the cooking spaces S1 and S2 are input through the cooking temperature condition input part 63 of the input part 60. For example, 27.5° C. is input into the upper space S1 of the separating plate, and 45° C. is input into the lower space S2 of the separating plate. Alternatively, 42.5° C. is input into the upper space S1 of the separating plate, and 32.5° C. is input into the lower space S2 of the separating plate.

In the separating plate moving step S2, the separating plate 10 is moved to a position input in the separating plate position input step.

In the separating plate moving step S2, the controller 70 drives the moving motor 52 so that the separating plate 10 is moved to the position input by the input part 6.

When the moving motor 52 is driven, the driving gear 54 rotates in engagement with the driven gear 56, and the driven gear 56 ascends or descends by the rotation of the driving gear 54, and the separating plate 10 is lifted and lowered, together with the driven gear 56.

When the driven gear 56 ascends, the separating plate 10 ascends, the upper space S1 of the separating plate becomes smaller, and the separating plate lower space S2 becomes gradually wider.

When the moving motor 52 is stopped, the driven gear 56 is stopped, and the separating plate 10 is fixed in position within the cavity 4.

As described above, after the position of the separating plate 10 is varied, the user puts an item into the upper space S1 of the separating plate 10 and the lower space S2 of the separating plate, and closes the door 6.

In the heating source control steps S3 and S4, when a cooking start command is input after the separating plate movement step, the first heating source 20 and second heating source 30 installed to heat the plurality of cooking spaces S1 and S2 independently are controlled at different temperatures.

When a cooking start command is input through the cooking start/stop input part 61 of the input part 60, the heating sources 20, 30, and 40 are controlled to be turned on, and the heating sources 20, 30, and 40 are controlled according to a cooking temperature condition input in the input step.

For instance, 27.5° C. is input into the upper space S1 of the separating plate, and 45° C. is input into the lower space S2 of the separating plate. The controller 70 controls the upper heater 20 to be set to a temperature lower than that of the lower heater 30, controls the upper heater 20 to heat the upper space S1 of the separating plate at 27.5° C., and controls the lower heater 30 to heat the lower space S2 of the separating plate at 45° C.

In the heating source control step S5, when a cooking time input through the input part 60 is reached, the heating sources 20, 30, and 40 are turned off.

At this point, in the heating source control steps S3, S4, and S5, the cooking time of the upper space S1 of the separating plate and the cooking time of the lower space S2 of the separating plate may be different, and the heating source 20 that has first reached the cooking time is turned off. Afterwards, the other heating source 30 is turned off.

Figure 10:
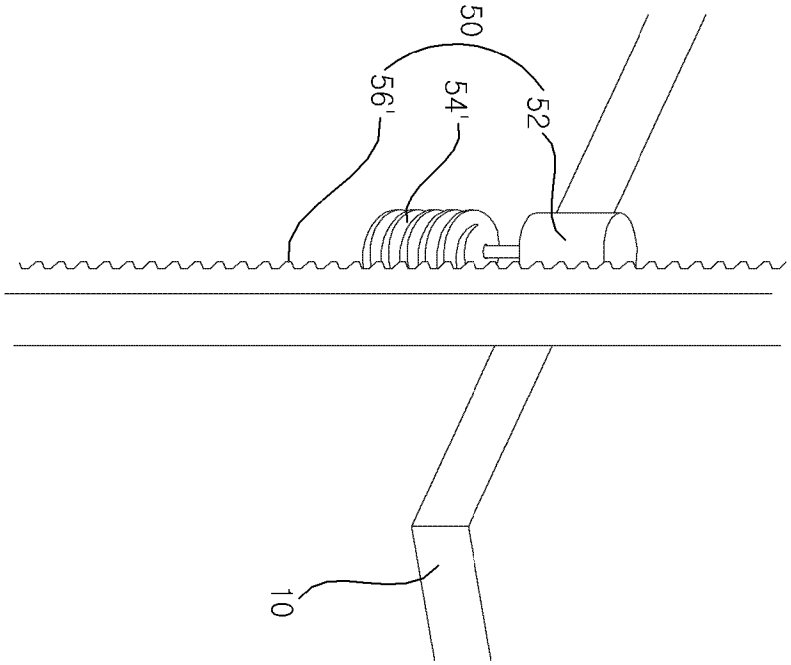
FIG. 10 is an enlarged cross-sectional view showing the main parts of a cooking appliance according to another exemplary embodiment of the present invention.

FIG. 10 is an enlarged cross-sectional view showing the main parts of a cooking appliance according to another exemplary embodiment of the present invention.

In the cooking appliance according to the present exemplary embodiment, the separating-plate moving mechanism 50 includes a driving worm gear serving as a driving gear 54' connected to a moving motor, which is a driving gear 52, and a driven worm gear serving as a driven gear 56' engaged with the worm gear and being long. Other components than the driving gear 54' and the driven gear 56' and operations thereof are identical or similar to the cooking appliance of one exemplary embodiment of the present invention. Thus, like elements are indicated by like reference numerals, and detailed descriptions thereof will be omitted.

The moving motor, which is the driving source 52, is disposed such that a rotating shaft protrudes in a vertical direction.

The driving worm gear, which is the driving gear 54', is longitudinally vertically disposed.

The driven worm gear, which is the driven gear 56', is longitudinally vertically disposed like the rack of one exemplary embodiment of the present invention.

Figure 11:
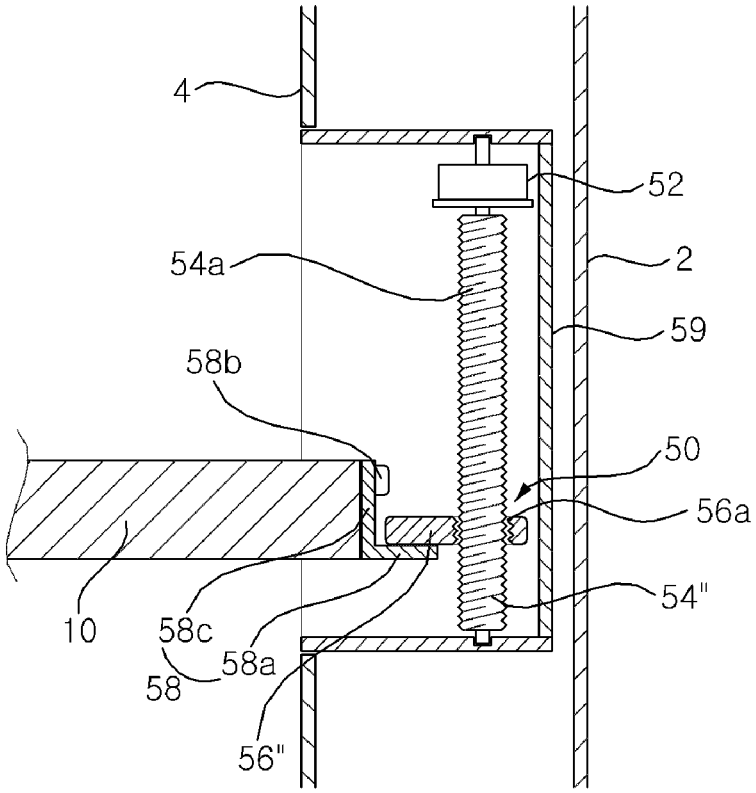
FIG. 11 is an enlarged perspective view showing the main parts of a cooking appliance according to yet another exemplary embodiment of the present invention.

FIG. 11 is an enlarged perspective view showing the main parts of a cooking appliance according to yet another exemplary embodiment of the present invention.

In the cooking appliance according to the present exemplary embodiment, the separating-plate moving mechanism 50 includes a driving gear 54" longitudinally vertically formed and a driven gear 56" protruding next to the separating plate 10 so as to be vertically moved along the driving gear 54". Other components than the driving gear 54" and the driven gear 56" and operations thereof are identical or similar to the cooking appliance of one exemplary embodiment of the present invention. Thus, like elements are indicated by like reference numerals, and detailed descriptions thereof will be omitted.

The driving gear 54" is a screw having a screw thread 54*a* formed on the outer surface.

The driven gear 56" is a lifting and lowering member which encloses part of the screw and has a screw thread 56*a* engaged with the thread of the screw so that it is lifted and lowered by being guided by the screw upon rotation of the screw. The lifting and lowering member is fixed to the separating plate 10 by a fixing bracket 58. The fixing bracket 58 includes a horizontal portion 58*a* to which the lifting and lowering member is fixed and a vertical portion 58*c* bent to be orthogonal to the horizontal portion 58*a* and fastened to the separating plate 10 by a fastening screw 58*b*. The present invention is not limited to the above described embodiments, and various variations and modifications may be possible without departing from the scope of the present invention.

The invention claimed is:

1. A cooking appliance comprising:

an outer case;

a cavity within the outer case;

a separating plate separating a plurality of cooking spaces in the cavity, and is capable of moving inside the cavity;

a first heating source a first cooking space;

a second heating source in a second cooking space; and a separating-plate moving mechanism for moving the separating plate vertically to vary a size of the cooking spaces, wherein the moving mechanism comprises:

a driving motor, a driving gear connected to the driving motor, a driven gear engaged with the driving gear and connected to the separating plate, and a motor case for housing the driving source and the driving gear, a driven gear guide guiding the driven gear, wherein the driven gear guide is longitudinally oriented in the cavity in the moving direction of the driven gear, wherein the motor case is opened in a direction facing the driven gear guide to engage the driven gear with the driving gear, wherein the motor case is between the cavity and the outer case, and wherein the motor case covers the driven gear guide.

2. The cooking appliance of claim 1, wherein the first heating source is an upper heater on a top of the cavity for heating an item supplied to an upper side of the separating plate, and the second heating source is a lower heater on a bottom of the cavity for heating an item supplied to a lower side of the separating plate.

3. The cooking appliance of claim 2, further comprising a third heating source behind the cavity for heating the plurality of cooking spaces at the same time.

4. The cooking appliance of claim 2, further comprising:

an input part for inputting variations in the position of the separating plate and inputting different cooking temperature conditions for the cooking spaces; and a controller for controlling the separating-plate moving mechanism in accordance with an input from the input part, and, upon receipt of a different cooking temperature condition from the input part, controlling the first heating source and the second heating source at different temperatures.

5. The cooking appliance of claim 1, wherein the driven gear is longitudinally oriented in a direction orthogonal to the separating plate.

6. The cooking appliance of claim 1, wherein the driven gear is at a center of a longitudinal or a lateral direction of the separating plate.

7. The cooking appliance of claim 1, wherein the driving gear is a pinion connected to the driving source, and the driven gear is a rack on the separating plate and engaged with the pinion.

8. The cooking appliance of claim 1, wherein the driving gear is a driving worm gear connected to a moving motor, and the driven gear is a driven worm gear on the separating plate and engaged with the worm gear.

9. The cooking appliance of claim 1, wherein the driving gear is oriented vertically, and wherein the driven gear protrudes next to the separating plate so as to be vertically moved along the driving gear.

10. The cooking appliance of claim 9, wherein the driving gear is a screw having a screw thread formed on the outer surface, and wherein the driven gear is a lifting and lowering member which encloses a portion of the screw and has a screw thread engaged with the thread of the screw so that the driven gear is lifted and lowered by being guided by the rotation of the screw.

11. The cooking appliance of claim 9, wherein the lifting and lowering member is disposed to protrude on the separating plate.

* * * * *